United States Patent [19]

Howorth

[11] Patent Number: 4,651,727

[45] Date of Patent: Mar. 24, 1987

[54] BODY EXHAUST GOWN ARRANGEMENT

[75] Inventor: Frederick H. Howorth, Ollerton, Near Chorley, England

[73] Assignee: Howorth Air Engineering Limited, England

[21] Appl. No.: 672,292

[22] Filed: Nov. 16, 1984

[30] Foreign Application Priority Data

Dec. 20, 1983 [GB] United Kingdom ..... 8333836

[51] Int. Cl.[4] ..... A62B 7/02

[52] U.S. Cl. ..... 128/201.23; 128/202.19; 128/206.28

[58] Field of Search ..... 128/200.27–200.28, 128/201.15, 201.22–201.24, 201.29, 202.19, 128/206.21–206.26, 206.28, 207.11

[56] References Cited

U.S. PATENT DOCUMENTS

| | | | |
|---|---|---|---|
| 3,403,677 | 10/1968 | Struve | 128/206.28 |
| 3,516,404 | 6/1970 | Spross | 128/201.29 X |
| 3,525,334 | 8/1970 | Braman et al. | 128/201.29 X |
| 3,625,207 | 12/1971 | Agnew | 128/206.28 |
| 3,804,086 | 4/1974 | Agnew | 128/202.19 |
| 4,019,508 | 4/1977 | Der Estaphanian et al. | 128/201.23 X |
| 4,055,173 | 10/1977 | Knab | 128/201.23 X |

FOREIGN PATENT DOCUMENTS

| | | |
|---|---|---|
| 1208284 | 10/1970 | United Kingdom . |
| 1395099 | 5/1975 | United Kingdom . |

*Primary Examiner*—Kyle L. Howell
*Assistant Examiner*—Angela D. Sykes
*Attorney, Agent, or Firm*—Bruns and Wall

[57] ABSTRACT

A sleeved gown is formed with an integral hood having a narrow front opening in line with the eyes of the wearer. The material of the gown is held in close contact with the wearer's face across the forehead and below the eyes but above the nose by means of tapes tied around the hood. An exhaust duct extends over each of the wearer's shoulders beneath the gown and has a plurality of exhaust inlets in the region of the wearer's chest. Preferably, upward airflow is restricted to a vertical passageway formed by an outward billowing of the gown material. This arrangement is most effective in drawing away air-borne emissions from the wearer's body and causing ambient air to enter from the bottom of the gown and gaps at each side of the wearer's nose. It is more comfortable than previous arrangements as there is no rigid mask or visor. Also as air extraction does not take place adjacent the wearer's face, no special communication equipment is required.

8 Claims, 5 Drawing Figures

BODY EXHAUST GOWN ARRANGEMENT

TECHNICAL FIELD

This invention relates to a body exhaust gown arrangement for use in operating theatres and other locations where contamination of ambient air by bodily emissions is to be minimised and, if possible, prevented.

BACKGROUND ART

It is well established that bacteria-carrying particles and epithelial scales are released continuously from the human body and that it is essential, in order to avoid as far as possible cross contamination of patients by operating theatre personnel, to take precautions to rid the atmosphere of operating theatres of such particles and scales. As part of the precautions relative thereto, conditioning of the air in operating theatres and/or in the immediate vicinity of operating tables is generally practised. Also, operating theatre personnel are required to wear all-enveloping gown-and-hood arrangements incorporating means adapted for connection to an air exhaust system. When such an arrangement is used, all airborne emissions within the gown and hood are drawn into the exhaust system by an air current such that the interior of the gown is maintained at a negative pressure and ambient air flows into the gown, usually from below. The material of the gown, is, of course, chosen so as to be an effective barrier to the passage of air and airborne emissions.

All previously proposed all-enveloping gown-and-hood arrangements of this type, as described, for example, in British Patent Specifications Nos. 1208284 and 1395099 have incorporated some form of rigid face mask or visor as well as some form of exhaust inlet to draw air from the region of the wearer's face. Such arrangements have proved cumbersome and uncomfortable to wear and have often given rise to difficulties in communication due to the physical barrier of the mask or visor and/or the noise of air being exhausted adjacent the face of the wearer. Indeed, expensive audio communication systems have sometimes been required to overcome the latter difficulty.

OBJECT OF THE INVENTION

It is an object of the present invention to provide a body exhaust gown arrangement which is equally as effective as previous arrangements in maintaining a negative pressure inside the gown but which does not incorporate a face mask or visor or require additional communication equipment and so is more comfortable and less expensive than previous arrangements.

SUMMARY OF INVENTION

With this object in view, the present invention provides a body exhaust gown arrangement comprising a sleeved gown formed with an integral hood having a front opening in line with the eyes of a wearer thereby enabling the wearer to see, a number of tapes being provided for tying around the hood in such a way that close contact between the material of the gown and the face of the wearer is achieved across the forehead and across the face below the eyes but above the end of the nose of the wearer, and exhaust duct means which is adapted for connection to an air exhaust system and which extends over each of the wearer's shoulders and has a plurality of exhaust inlets in the region of the wearer's chest, beneath the gown.

Preferably a pair of tapes are attached to the gown at each side of the front opening, and these are designed to be tied together at the back of the head of the wearer.

In use, when the exhaust duct means is connected to an operational air exhaust system, air contaminated by emissions from the body of the wearer is continually drawn from the interior of the gown which is thus maintained at a negative pressure. Ambient air flows into the interior of the gown from beneath the lower edge of the gown. Air also enters the gown by way of two gaps which inevitably remain between the material of the gown and the face of the wearer at each side of the nose of the wearer.

To ensure that inflow of air through the two gaps adjacent to the nose is maintained, that is to say to ensure that no contaminated air can possibly move out through these gaps, upward air-flow from the bottom of the gown is preferably restricted to a vertical passageway formed by an outward billowing of the gown material. To produce such a billowing, a strap may conveniently be attached across the inside of the front of the gown in the region of the wearer's waist with fastening means being provided to hold the sides and back of the gown close to the wearer's body in the same region.

The fastening means may simply consist of a pair of tapes or tie cords, one attached externally to each side of the gown, which are designed to be tied together at the back of the wearer.

With such an arrangement a further strap is advantageously attached across the inside of the front of the gown in the region of the wearer's shoulders to ensure that the outward billowing of the gown material defining the vertical passageway extends to the wearer's face.

In an alternative, less favourable embodiment of the invention, restriction of the upward airflow from the bottom of the gown may be brought about by restricting the size of the aperture at the bottom of the gown, for example by providing fastening means to fasten together material from the front and from the back of the gown between the wearer's legs. Preferably, such fastening means consist of a pair of tapes one located centrally at the front of the lower edge of the gown and the other located centrally at the back of the lower edge, which tapes are of sufficient length to be easily tied together after the wearer has donned the gown.

In another alternative, also less favourable, embodiment, the gown may simply be tied externally around the waist of the wearer by means of a tie cord or belt. This results in increased inward flow of ambient air through the face opening and gaps adjacent the wearer's nose but since upflow of air from below the waist is virtually prevented, emission of contaminated air from the bottom of the gown is likely to occur. This will only be acceptable in an environment having downwardly flowing sterile air which will hold any such emissions adjacent the ground where they can do no harm.

In all the aforesaid body exhaust gown arrangements the exhaust duct means is conveniently in the form of a loop for fitting to the wearer in the manner of a large necklace and having exhaust inlets at intervals therealong. The loop is advantageously composed of alternate lengths of flexible corrugated tubing and short sections of non-flexible tubing, each of which has therein a respective exhaust inlet.

Preferably the loop connects by its ends to a Y-shaped connector whereby it may be connected to a single flexible exhaust tube extending down the rear of the gown and adapted to be connected to the air exhaust system.

A tie cord or the like is preferably connected to the looped exhaust duct to enable the wearer to secure the duct in place, after it has been positioned conveniently and comfortably on his/her chest, by tying the cord around his/her waist.

BRIEF DESCRIPTION OF DRAWINGS

In order that the invention may be fully understood it will be described further, by way of example, with reference to the accompanying drawings, in which.

DETAILED DESCRIPTION OF ILLUSTRATED EMBODIMENTS

Figure 1:
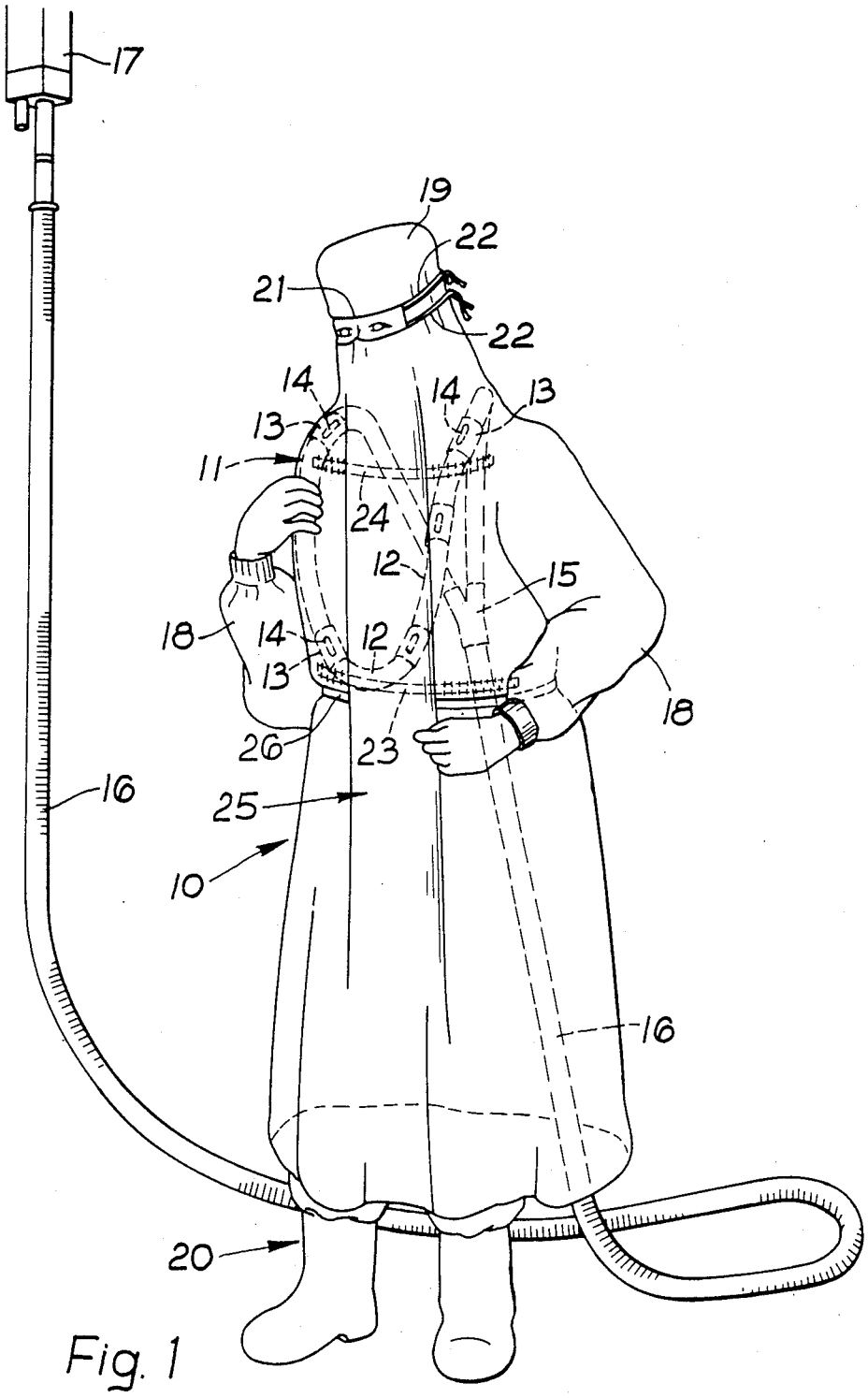
FIG. 1 is a front perspective view showing a preferred embodiment of the entire gown arrangement of the invention in use one a wearer and connected to an air exhaust system.

As shown in FIG. 1, a preferred embodiment of the body exhaust gown arrangement of the invention comprises, in combination, a fabric gown, indicated generally by reference numeral 10 and exhaust duct means in the form of a loop 11. The loop 11 is composed of alternate lengths 12 of flexible corrugated tubing and short sections 13 of non-flexible (e.g. metal) tubing each of which has therein a respective exhaust inlet in the form of a slot 14. The exhaust duct loop 11 is intended to be fitted to a wearer 20 (who will, of course be wearing undergarments) in the manner of a large necklace and has two ends which fit into a Y-shaped connector 15 resting against the back of the wearer 20. A tie cord 28 (see FIG. 4) is provided at approximately the centre of the loop 11, opposite to the connector 15, and the wearer 20 uses this to retain the loop in position with portions thereof extending over his/her shoulders and the main part of the loop 11 overlying the front of his/her torso, by tying the cord around his/her waist before donning the gown.

After the exhaust loop 11 is positioned, as just explained, it is coupled by means of the Y-shaped connector 15 to a single flexible exhaust tube 16 which extends down the rear of the wearer 20 and is connected to an air exhaust system 17 (FIG. 1) in an operating theatre in which the arrangement is to be used.

After the exhaust duct loop 11 is fitted in place about the wearer's body the wearer 20 dons the gown 10 which is preferably made of closely-woven textile fabric. The gown 10 includes a relatively loose-fitting body part having sleeves 18 which can be fitted tightly to the wearer's wrist and an integral hood 19 which completely covers the wearer's head having only a narrow opening 21 in line with the wearer's eyes, through which the wearer is able to see. The opening 21 is a generally rectangular horizontal slot and a first pair of tapes 22 is sewn or otherwise attached at one side of the opening 21 adjacent the upper and lower corners respectively. A second pair of tapes (not visible) is similarly attached at the other side of the opening 21. The upper and lower tapes of each pair are conducted around the respective side of the wearer's head and are tied to the corresponding tapes from the other pair at the back of the head so as to bring about close contact between the gown material and the face of the wearer across the forehead and below the eyes, but above the end of the nose, of the wearer. The tightness of fit may, of course, be varied by the degree of tension applied to the tapes before they are tied. The first and second pairs of tapes will generally be tied as tightly as is possible without causing discomfort to the wearer.

Figure 2:
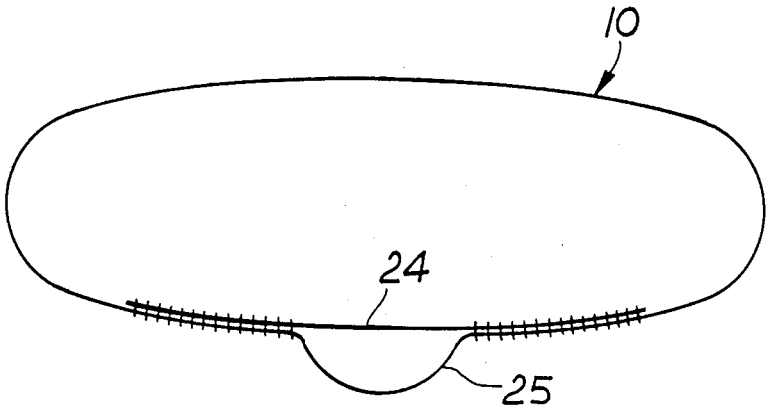
FIG. 2 is a diagrammatic cross-section through the gown arrangement of FIG. 1 at the level of the shoulders of the wearer.
Figure 3:
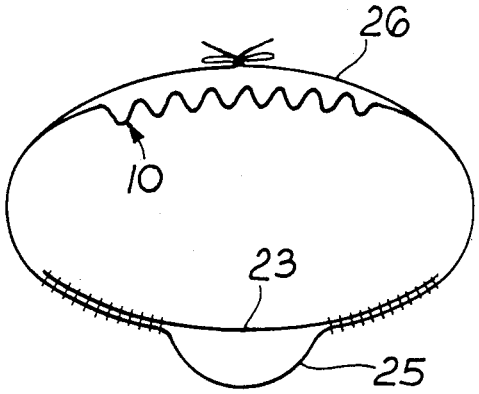
FIG. 3 is a similar view at the level of the waist of the wearer.

As illustrated in FIG. 3, a strap 23 is sewn or otherwise attached across the inside of the front of the gown in the region of the wearer's waist. The strap 23 is attached at its end only at right and left sides of the gown so as to provide centrally an outward billowing 25 of the gown material. In other words, the central portion of the strap 23 is not attached to the gown material and provides a bridging piece between the attached ends which is considerably shorter than the length of gown material disposed between the attachment areas. As shown in FIG. 2, a similar strap 24 is attached in similar manner across the inside of the front of the gown in the region of the wearer's shoulders.

In addition, at the waist, fastening means in the form of tapes or tie cords 26 are provided. These are attached externally of the gown, one adjacent each of the two attachment areas of the strap 23. When tied together behind the wearer's back, as in FIGS. 1 and 3, these tapes or tie cords 26 gather in the sides and back of the gown 10 and hold same close to the wearer's body.

The vertical air passageway provided at the front of the gown by the outward billowing 25 of the gown material is extremely important, as will be explained.

The gown 10 itself forms a barrier preventing dissemination of body emissions from the wearer into the ambient air. When the air exhaust system 17 is operated, contaminated air between the undergarments of the wearer 20 and the gown 10 is continuously drawn into the exhaust system by way of the inlets 14 in the exhaust duct loop 11. Air continuously flows into the interior of the gown 10 to replace the exhausted air. This air flows in through gaps which remain between the face of the wearer and the garment material at either side of the nose, and also from the bottom of the gown. The restricted air passageway provided beneath the gown between the lower part of the gown and the chest region where air exhaustion is occurring is extemely important in ensuring that a sufficient rate of inflow via the gaps adjacent the nose is maintained so that outflow of contaminated air from these gaps is prevented. Moreover, since the tightness with which the tapes or tie cords 26 are secured can be adjusted, the rate of inflow can, to a certain extent, also be controlled.

Figure 4:
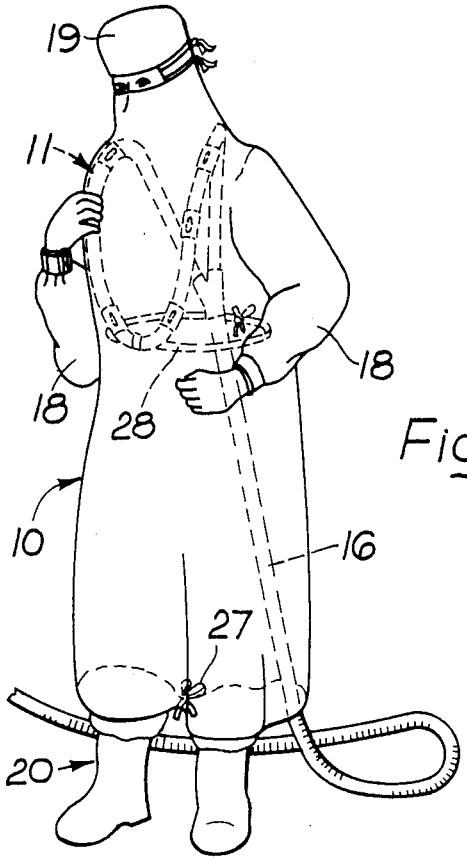
FIG. 4 is a front perspective view, to a reduced scale, of a second embodiment of the gown arrangement of the invention in use on a wearer.

In an alternative embodiment, as shown in FIG. 4, restriction of upward airflow from the bottom of the gown is brought about by providing fastening means in the form of another pair of tapes 27 located at the front and back of the lower edge of the skirt which are tied together between the wearer's legs. This simply restricts the size of the aperture at the bottom of the gown and may not be as effective as providing a restricted fronted air passageway as in the above-described embodiment. In other respects, however, the arrangement shown in FIG. 4 is the same as that in FIG. 1.

Figure 5:
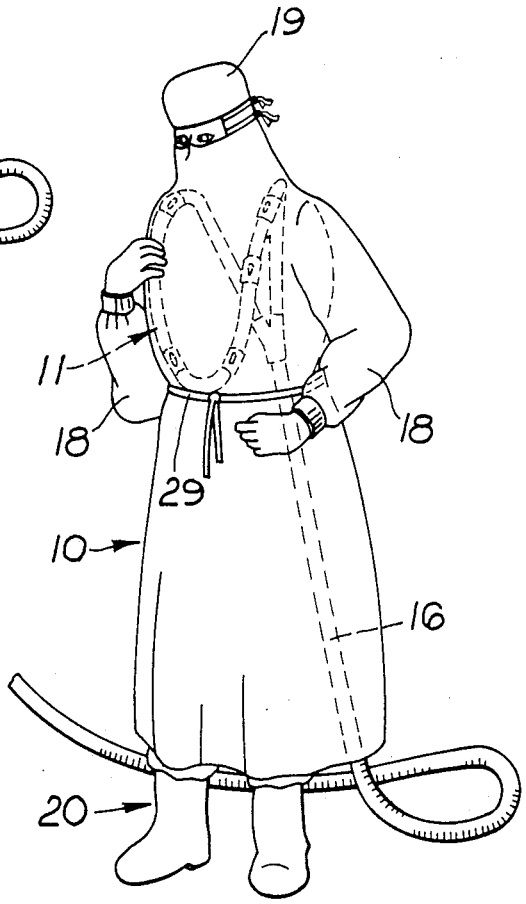
FIG. 5 is a similar view of a third embodiment.

In another alternative arrangement, as illustrated in FIG. 5, the gown 10 is tied externally around the wearer's waist (instead of between his legs) by means of a tie cord or belt 29. This is *only* feasible when the gown arrangement is going to be used *in* an operating theatre having a downstream of sterile air because when the waist is thus constricted exhaustion of air from beneath the gown beneath the waist is virtually prevented and contaminated air will probably flow out of the bottom of the gown. The downstream of sterile air, however, is usually effective to hold such contaminated air adjacent the floor so it cannot do any harm. Again, in other respects the arrangement shown in FIG. 5 is the same as that shown in FIG. 1.

In all the aforesaid embodiments, the gown may be made with no other opening, save those at the bottom of the skirt, the wrists and for vision, so that it has to be pulled on over the wearer's head. Alternatively there may be an opening right down the back so that the wearer can walk-in and be tied in down the back as in conventional threatre gowns.

The body exhaust gown arrangement in accordance with the invention is particularly favourable because it is equally as effective as prior arrangements in preventing dissemination of body emissions from the wearer into the ambient air yet is far lighter and more comfortable and convenient because it does not have a face mask or visor (which is often heavy and bulky) and there is no difficulty for a wearer in communicating with other personnel who may also be fitted with similar body exhaust gowns. Moreover, the proposed arrangement is particularly simple and inexpensive to produce and easy for the wearer to put on and take off.

The body exhaust gown arrangement is not, of course, limited to the exact details of the illustrated embodiments and many variations are possible within the scope of the invention. For example, the exact manner of provision of the tapes for tying around the head and the way in which they are conducted around the wearer's head and the position in which they are tied may differ from that described. Pairs of tapes may be sewn or otherwise attached substantially centrally above and below the opening for the eyes or only one pair of long tapes may be provided each of which may be conducted once or one and a half times around the wearer's head before they are tied together. Alternatively one or more tapes may be tied to small loops provided on the hood. The tapes are, for obvious reasons, preferably tied at the back of the head of the wearer so that they do not interfere with vision or work of the wearer. However, this is not essential and they may be tied at the side if the wearer so wishes.

Moreover, where fastening means are provided for closing the gown between the legs, these need not consist of tapes and press fasteners or buttons could alternatively be used. Also the precise form of the exhaust duct means and the manner in which it is coupled to the air exhaust system can differ in detail from the example described and illustrated.

I claim:

1. A body exhaust gown arrangement comprising: a sleeved gown formed with an integral hood having a front opening in line with the eyes of a wearer thereby enabling the wearer to see; a number of tapes attached externally to said hood, said tapes tying around the hood across portions of said hood adapted to contact the forehead and the face of the wearer below the eyes but above the end of the nose of the wearer in such a way that close contact between the material of the gown and the face of the wearer is achieved, a first strap attached across the inside of the front of said gown in the region of the wearer's waist, a second strap attached across the inside of the front of said gown in the region of the wearer's shoulders, and fastening means attached to the outside of said gown to hold the sides and back of said gown close to the wearer's body in the same region, which together cooperate in a manner such as to provide means producing an outward billowing of the gown material at the front only defining a restricted air passageway from the lower part of the gown to the face; and exhaust duct means for connection to an air exhaust system, said exhaust duct means adapted to extend over each of the wearer's shoulders beneath the gown and having a plurality of exhaust inlets in the region of the wearer's chest.

2. A body exhaust gown arrangement comprising a sleeved gown formed with an integral hood having a front opening in line with the eyes of a wearer thereby enabling the wearer to see, a number of tapes attached externally to the hood, said tapes tying around said hood across portions of said hood adapted to contact the forehead and the face of the wearer below the eyes but above the end of the nose of the wearer in such a way that close contact between the material of the gown and the face of the wearer is achieved and exhaust duct means for connecting to an air exhaust system, said exhaust duct means adapted to extend over each of the wearer's shoulders beneath the gown, and having a plurality of exhaust inlets in the region of the wearer's chest, the gown arrangement further including a strap attached across the inside of the front of said gown in the region of the wearer's waist in a manner such as to provide means producing an outward billowing of the gown defining a vertical air passageway, and fastening means attached to the outside of said gown in the region of the wearer's waist to hold the sides and back of said gown close to the wearer's body in the same region.

3. A gown arrangement as set forth in claim 2 wherein a pair of tapes are attached to said hood at each side of said front opening, said tapes being designed to be tied together at the back of the head of the wearer.

4. A gown arrangement as set forth in claim 2 including a further strap attached across the inside of the front of said gown in the region of the wearer's shoulders to ensure that the outward billowing of the gown material defining the vertical passageway extends to the wearer's face.

5. A gown arrangement as set forth in claim 2 wherein fastening means are provided to fasten together material from the front and from the back of the gown between the wearer's legs to restrict the size of the aperture at the bottom of the gown.

6. A gown arrangement as set forth in claim 2 wherein said exhaust duct means is in the form of a loop fitting to the wearer in the manner of a large necklace, said loop being composed of alternate lengths of flexible corrugated tubing and short sections of non-flexible tubing, each of which has therein a respective exhaust inlet.

7. A gown arrangement as set forth in claim 6 wherein said loop connects by its ends to a Y-shaped connector whereby it is connected to a single flexible exhaust tube extending down the rear of the gown and adapted to be connected to the air exhaust system.

8. A gown arrangement as set forth in claim 6 wherein a tie cord or the like is connected to the looped exhaust duct means to enable the wearer to secure the duct means in place, after it has been positioned on his/her chest, by tying the cord around his/her waist beneath the gown.

* * * * *